US010906337B2

(12) United States Patent
Weeks et al.

(10) Patent No.: US 10,906,337 B2
(45) Date of Patent: Feb. 2, 2021

(54) PRINTER PAPER BUCKET WITH ROTATING SPINDLE MECHANISM FOR ACCOMMODATING MEDIA ROLLS OF VARYING WIDTH

(71) Applicant: TransAct Technologies Incorporated, Hamden, CT (US)

(72) Inventors: David Weeks, Willseyville, NY (US); Peter Zach, Ithaca, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 0 days.

(21) Appl. No.: 16/671,310

(22) Filed: Nov. 1, 2019

(65) Prior Publication Data

US 2020/0147984 A1 May 14, 2020

Related U.S. Application Data

(60) Provisional application No. 62/757,927, filed on Nov. 9, 2018.

(51) Int. Cl.
*B41J 15/04* (2006.01)
*B65H 16/06* (2006.01)

(52) U.S. Cl.
CPC ..... *B41J 15/042* (2013.01); *B65H 16/06* (2013.01)

(58) Field of Classification Search
CPC ..... B41J 15/042; B41J 11/0025; B65H 16/06; B65H 2402/342; B65H 2402/22; B65H 2301/41308; B65H 2301/41346; B65H 2801/12; B65H 2511/12
See application file for complete search history.

(56) References Cited

U.S. PATENT DOCUMENTS 4,544,109 A * 10/1985 Andreasson ..... B65H 16/06 242/559.2
2002/0096075 A1* 7/2002 Kaya ..... B41J 15/042 101/475
2005/0258301 A1* 11/2005 Hirte ..... B65H 75/242 242/597.6
2019/0127170 A1* 5/2019 Harris ..... B65H 75/08

OTHER PUBLICATIONS

ZIH Corp.; Zebra ZD410 Setup Guide; 2015; 2 pages.
Lightspeed; "Setting up the Zebra ZD410 on a computer for custom label printing"; URL <https://retail-support.lightspeedhq.com/hc/en-us/articles/231779808-Setting-up-the-Zebra-ZD410-on-a-computer-for-custom-label-printing>; retrieved on Nov. 18, 2019; pp. 1-3.

* cited by examiner

*Primary Examiner* — Sharon Polk
(74) *Attorney, Agent, or Firm* — Lipsitz & McAllister, LLC

(57) ABSTRACT

A paper bucket for a printer with a self-adjusting spindle mechanism capable of accommodating media rolls of varying width is provided, together with a printer having such a paper bucket and corresponding method. The adjustable paper bucket may have a bucket frame and oppositely disposed wall assemblies pivotally mounted in the bucket frame. The adjustable paper bucket may further include oppositely disposed vertical flanges, each of the vertical flanges being pivotally mounted to a respective one of the wall assemblies. A spindle flange is rotatably mounted to each vertical flange for accepting a media roll therebetween. A motion linkage connects the wall assemblies together such that a movement of one of the wall assemblies results in an equal and opposite movement of the other one of the wall assemblies.

18 Claims, 6 Drawing Sheets

PRINTER PAPER BUCKET WITH ROTATING SPINDLE MECHANISM FOR ACCOMMODATING MEDIA ROLLS OF VARYING WIDTH

This application claims the benefit of commonly owned U.S. provisional application No. 62/757,927 filed on Nov. 9, 2018, which is incorporated herein and made a part hereof by reference

BACKGROUND OF THE INVENTION

The present invention relates to the field of printers. More specifically, the present invention relates to a paper bucket for a printer with a self-adjusting spindle mechanism capable of accommodating media rolls of varying width.

Various types of printers that print on media rolls may be used in different environments that may require different roll widths. For example, printers using media rolls (e.g., rolls of paper, rolls of label stock, or the like) may include point-of-sale printers, label printers used for inventory control and food preparation, ATM printers, lottery ticket printers, gaming machine printers, and the like. Depending on the environment and application, different width media rolls may be used or required.

Prior art printers are either manufactured with a fixed bucket width for one of several standard-sized paper rolls, or use removable screw mounted side guides, manually adjustable side guides, or manually adjustable spindle stops, all which require user adjustment before changing roll size.

It would be advantageous to provide a paper bucket with a self-adjusting spindle mechanism that can accommodate infinitely variable widths of media rolls. It would be further advantageous to enable such a self-adjusting spindle mechanism to accommodate media rolls having different core dimensions.

The apparatus and methods of the present invention provide the foregoing and other advantages.

SUMMARY OF THE INVENTION

The present invention relates to a paper bucket for a printer with a self-adjusting spindle mechanism capable of accommodating media rolls of varying width.

A paper bucket in accordance with an example embodiment of the present invention is capable of accepting different media rolls of infinitely varying widths within a predetermined width range. The paper bucket supports the media rolls on a rotating spindle mechanism comprised of two oppositely disposed rotating spindle flanges. The spindle flanges are each rotatably mounted on a respective vertical flange and are free to spin about their respective mounts. The vertical flanges are each pivotally mounted to a mechanical wall assembly via two shafts that keep the flanges in a vertical orientation regardless of positioning. The mechanical wall assemblies are arranged facing each other and each comprises a central pivoting support and an orienting member. The vertical flanges are each pivotally connected to a top section of the central pivoting support by a first shaft and to a top section of the orienting member via a second shaft. A motion linkage connects the wall assemblies together and maintains the spindle flanges, as well as the vertical flanges, in a parallel orientation with one another.

An example embodiment of an adjustable paper bucket for accommodating media rolls of varying widths in accordance with the present invention comprises a bucket frame, and oppositely disposed wall assemblies pivotally mounted in the bucket frame. The adjustable paper bucket further comprises oppositely disposed vertical flanges, each of the vertical flanges being pivotally mounted to a respective one of the wall assemblies. A spindle flange is rotatably mounted to each vertical flange for accepting a media roll therebetween. A motion linkage connects the wall assemblies together such that a movement of one of the wall assemblies results in an equal and opposite movement of the other one of the wall assemblies.

The vertical flanges are each pivotally mounted to the wall assembly via two shafts arranged to maintain the vertical flanges and the spindle flanges in a vertical orientation regardless of positioning of the wall assemblies.

The wall assemblies may each comprise a central pivoting support pivotally connected to the bucket frame and a corresponding one of the vertical flanges, and an orienting member pivotally connected to the bucket frame and a corresponding one of the vertical flanges.

A corresponding first shaft may pivotally connect each of the vertical flanges to a top section of the corresponding central pivoting support. A corresponding second shaft may pivotally connect each of the vertical flanges to a top section of the orienting member. A corresponding third shaft may pivotally connect each respective end of the motion linkage to a bottom section of the corresponding central pivoting support. A corresponding fourth shaft may pivotally connect a bottom section of each of the corresponding orienting members to the bucket frame. A corresponding fifth shaft may pivotally connect a bottom section of each of the central pivoting supports to the bucket frame. The first shafts, the second shafts, the third shafts, the fourth shafts, and the fifth shafts may all extend parallel to one another.

The motion linkage may comprise a respective linkage section pivotally connected on one end to a bottom section of each central pivoting support and connected on the other end to a cam arm of a cam via a pin that has a sliding connection to a fitted slot in the cam arm. The motion linkage may further comprise a respective spring connecting each linkage section to the bucket frame. The springs may bias the wall assemblies and spindle flanges towards one another into a default position. The spindle flanges may be biased towards one another in a default position a preset distance apart.

The spindle flanges may be movable between a predefined default position and a predefined fully opened position to accommodate the media roll. A width of the media roll acceptable by the spindle flanges may be any width between the predefined default position and the predefined fully open position.

The spindle flanges may maintain the media roll in a centered position in the paper bucket regardless of the width of the media roll.

The spindle flanges may each comprise a cylindrical projection, the cylindrical projections being coaxial and extending towards one another into a center of the paper bucket. The cylindrical projections may be sized to fit inside a hollow core of the media roll. The cylindrical projections may each comprise a plurality of coaxial stepped projections, each of the stepped projections being progressively smaller in a direction towards the center of the paper bucket and sized to fit within a correspondingly different size of the hollow core.

The spindle flanges may rotate as media from the media roll is drawn into a printer.

The present invention also encompasses a printer with an adjustable paper bucket. An example embodiment of a printer in accordance with the present invention comprises a printer housing, a printer mechanism disposed in the printer housing, and a paper bucket disposed in the printer housing adapted to hold a media roll to be fed into the printer mechanism. The paper bucket comprises a self-adjusting spindle mechanism for accommodating media rolls of varying widths. The self-adjusting spindle mechanism may comprise oppositely disposed wall assemblies pivotally mounted in a bucket frame of the paper bucket and oppositely disposed vertical flanges, each of the vertical flanges being pivotally mounted to a respective one of the wall assemblies. A spindle flange may be rotatably mounted to each vertical flange for accepting the media roll therebetween. A motion linkage connects the wall assemblies together such that a movement of one of the wall assemblies results in an equal and opposite movement of the other one of the wall assemblies.

The printer may also include additional features discussed above in connection with the various embodiments of the paper bucket.

The present invention also encompasses a method for providing an adjustable paper bucket for accommodating media rolls of varying widths. In one example embodiment, the method may comprise providing a bucket frame, pivotally mounting oppositely disposed wall assemblies in the bucket frame, providing oppositely disposed vertical flanges, each of the vertical flanges being pivotally mounted to a respective one of the wall assemblies, and rotatably mounting a spindle flange to each vertical flange for accepting a media roll therebetween. The wall assemblies may be connected together via a motion linkage such that a movement of one of the wall assemblies results in an equal and opposite movement of the other one of the wall assemblies.

The method may also include elements and features of the adjustable paper bucket discussed above.

BRIEF DESCRIPTION OF THE DRAWINGS

The present invention will hereinafter be described in conjunction with the appended drawing figures, wherein like reference numerals denote like elements, and.

DETAILED DESCRIPTION

Figure 1:
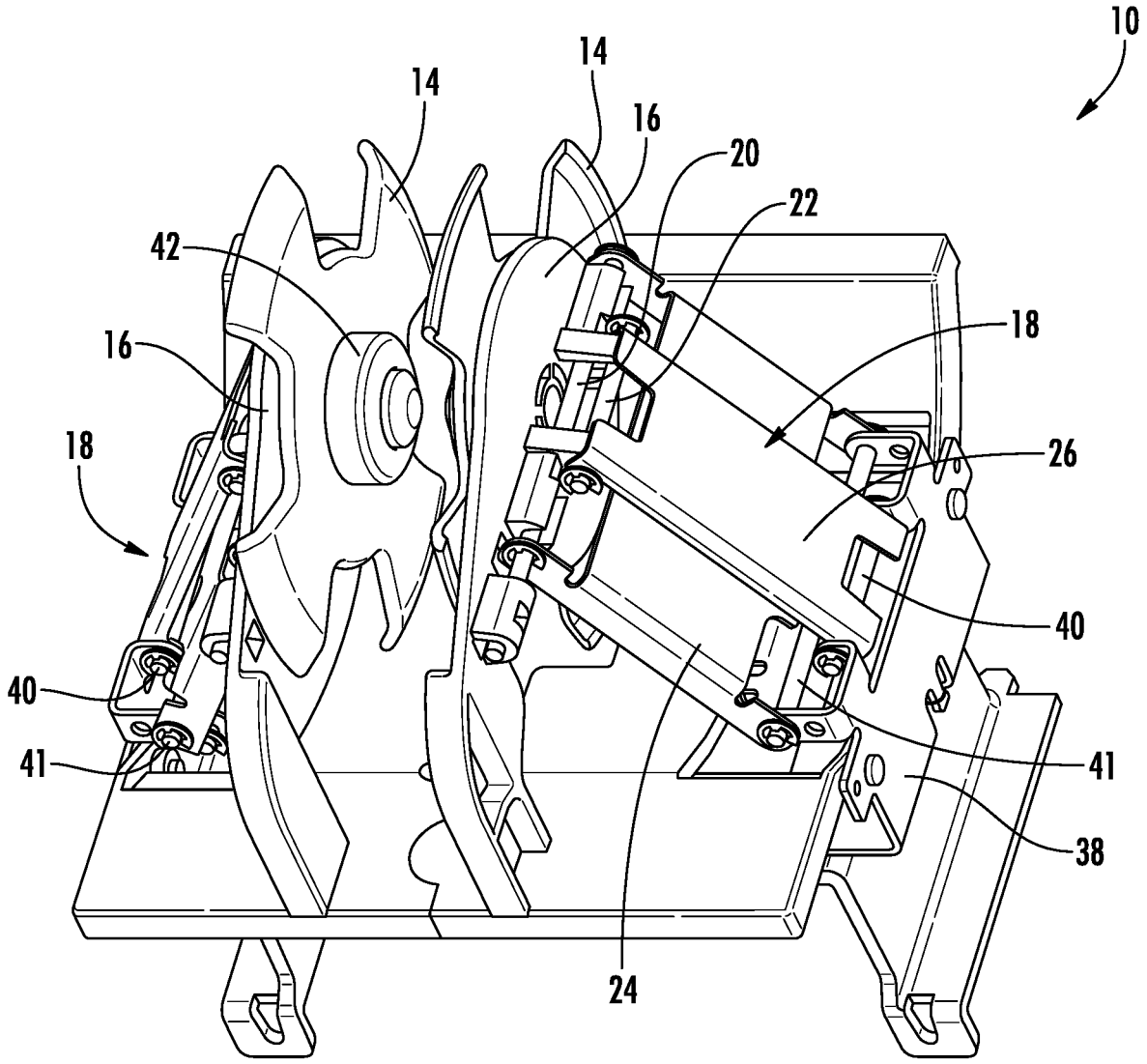
FIGS. 1-4 show an example embodiment of a paper bucket in accordance with the present invention.
Figure 2:
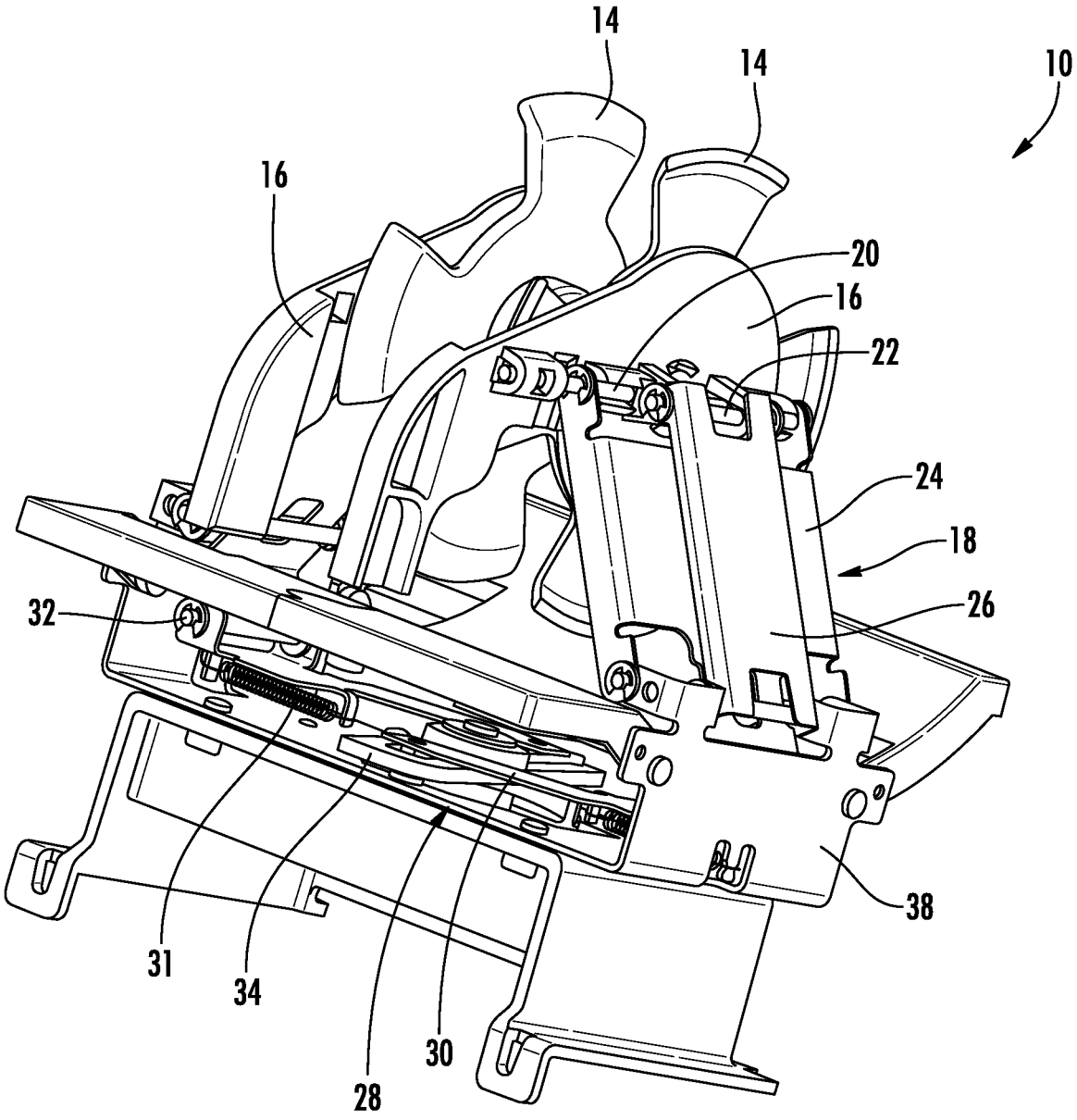
Figure 3:
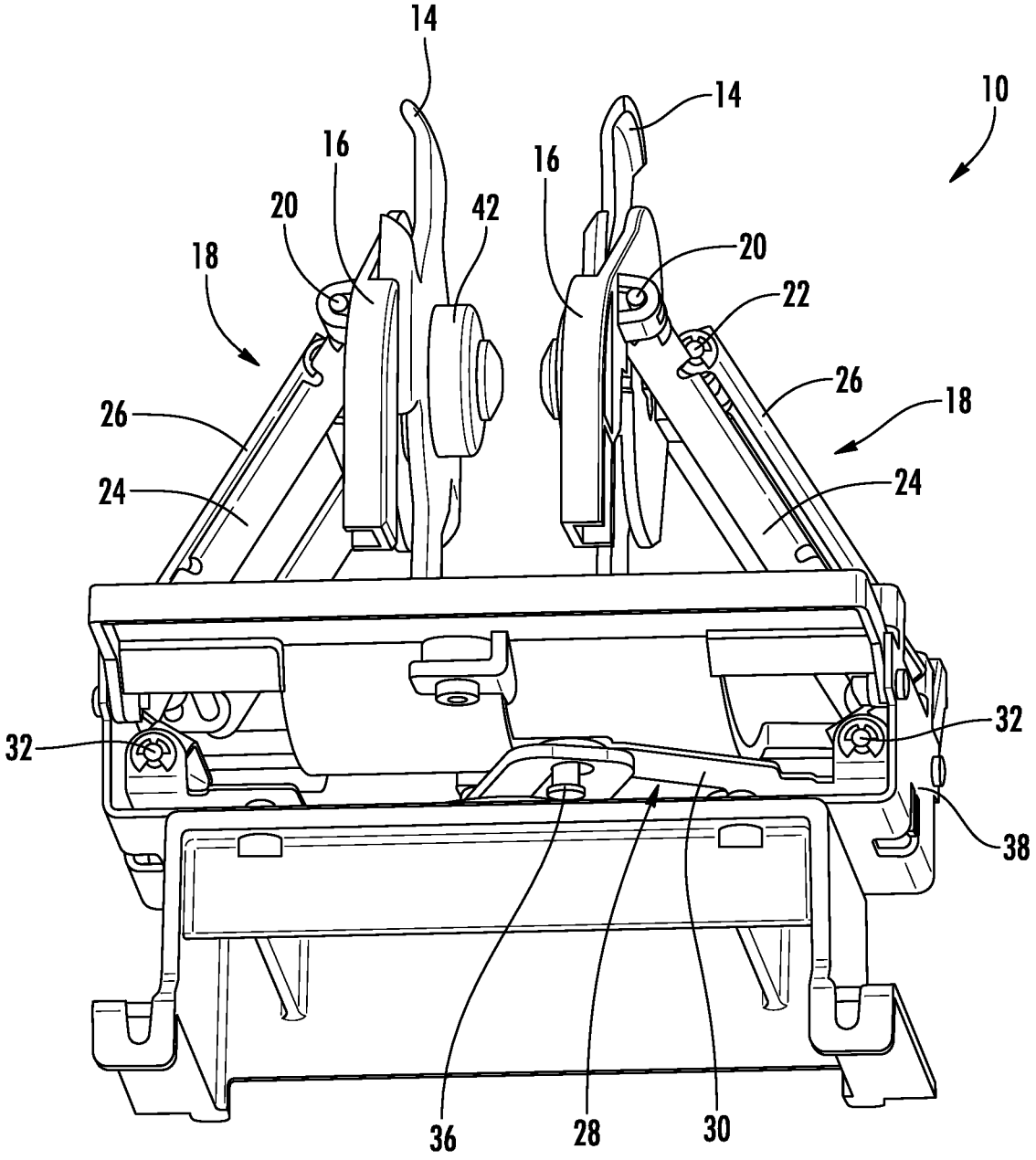
Figure 4:
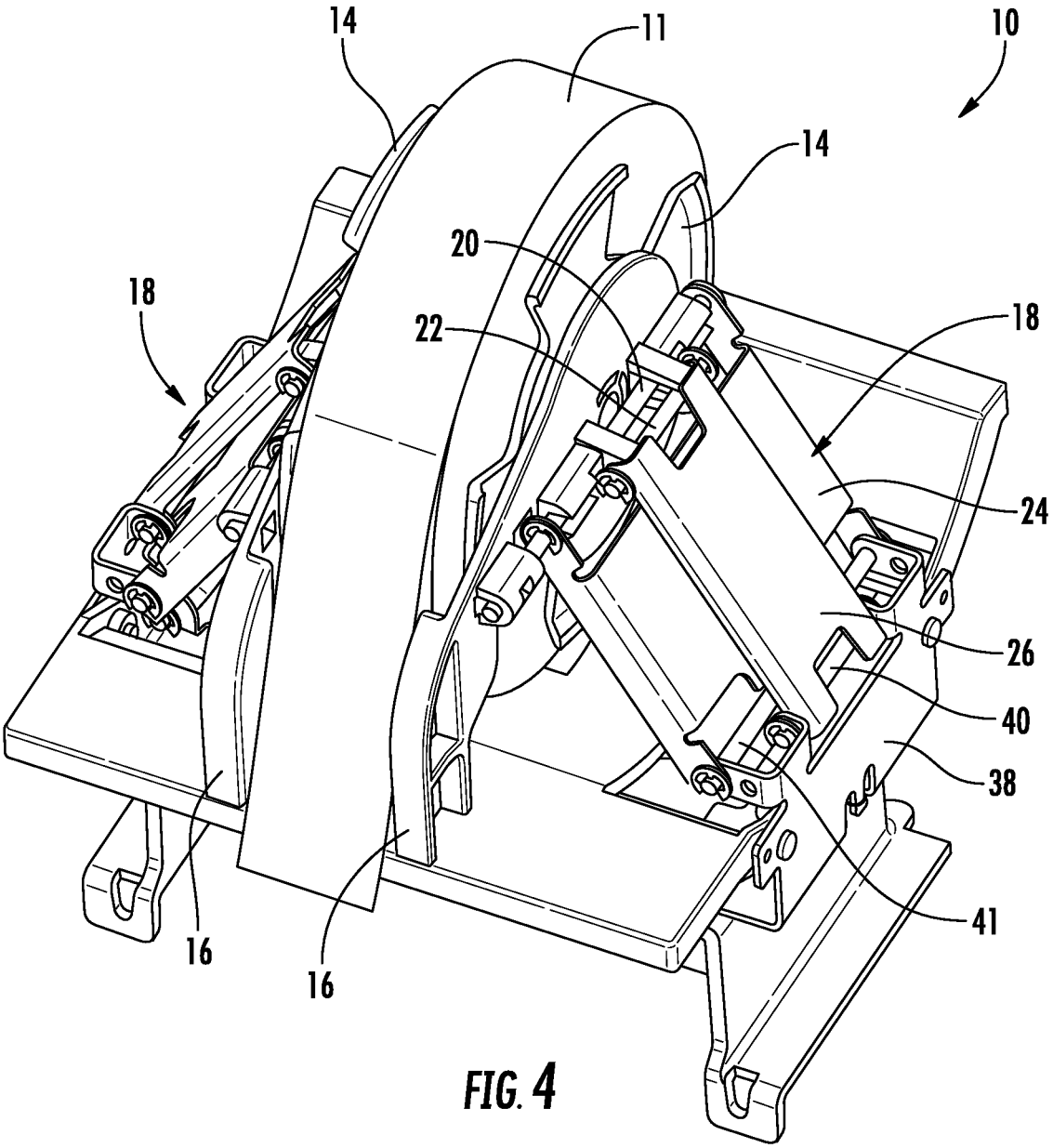

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

FIGS. 1-4 show an example embodiment of a paper bucket 10 in accordance with the present invention which is capable of accepting different media rolls 11 of infinitely varying widths within a predetermined width range. The paper bucket 10 comprises a bucket frame 38 which supports a rotating spindle mechanism comprised of two oppositely disposed rotating spindle flanges 14 which are adapted to support a media roll 11 therebetween. The spindle flanges 14 are each rotatably mounted on a respective vertical flange 16 and are free to spin about their respective mounts. The vertical flanges 16 are oppositely disposed and are each pivotally mounted to a mechanical wall assembly 18 via two shafts 20, 22 that keep the vertical flanges 16 in a vertical orientation regardless of positioning. The mechanical wall assemblies 18 are oppositely disposed and each are pivotally mounted in the bucket frame 38 such that they are arranged facing each other. A motion linkage 28 connects the wall assemblies 18 together such that a movement of one of the wall assemblies 18 results in an equal and opposite movement of the other one of the wall assemblies 18.

Figure 5:
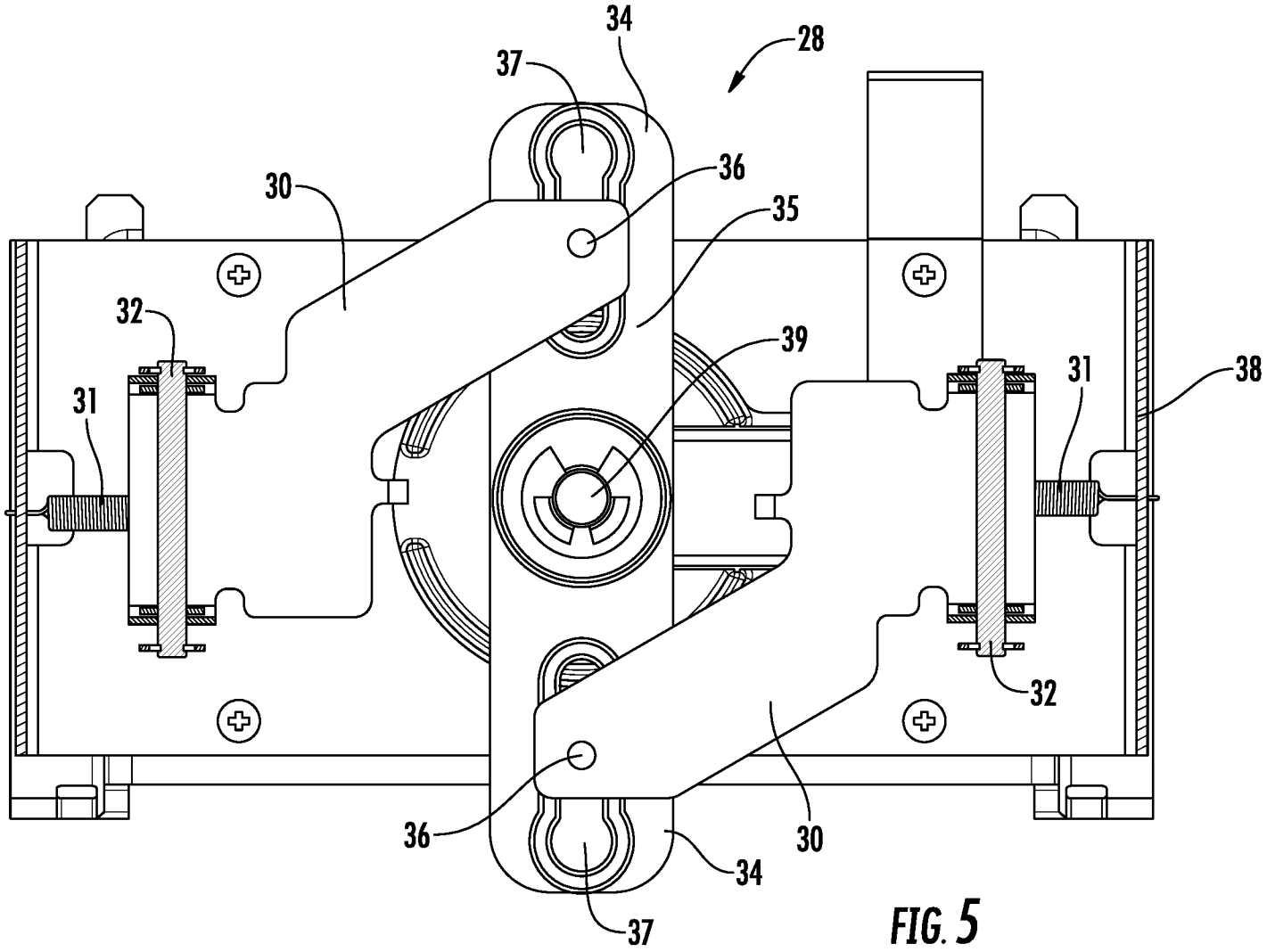
FIG. 5 shows a horizontal cross-section below the floor of the paper bucket illustrating an example embodiment of a motion linkage connecting oppositely disposed wall assemblies of the paper bucket of FIGS. 1-4.

The wall assemblies 18 each comprise a central pivoting support 24 and an orienting member 26. The vertical flanges 16 are each pivotally connected to a top section of the central pivoting support 24 by a first shaft 20 and to a top section of the orienting member 26 via a second shaft 22. The motion linkage 28, which may be located under a floor of the paper bucket 38, connects the wall assemblies 18 together and maintains the spindle flanges 14 in a parallel orientation with one another. As shown in FIG. 5, the motion linkage 28 comprises a respective linkage section 30 pivotally connected on one end to a bottom section of each central pivoting support 24 via a third shaft 32 and connected on the other end to a cam arm 34 of a cam 35 via a pin 36 that has a sliding connection to a fitted slot 37 in the cam arm 34. Each linkage section 30 has a spring 31 connecting it to the bucket frame 38. The cam 35 pivots on a central pivot pin 39. A bottom section of each of the orienting members 26 is pivotally connected to the bucket frame 38 via a fourth shaft 40. A bottom section of each central pivoting support 24 is also pivotally connected to the bucket frame 38 via a fifth shaft 41. Each of the shafts 20, 22, 32, 40, 41 extend parallel to one another.

Due to connection and arrangement of the wall assemblies 18, a movement of one wall assembly 18 will induce the equal and opposite movement of the opposing wall assembly 18, resulting in corresponding movement of the spindle flanges 14.

In use, the wall assemblies 18 can be pivoted open from a default position (e.g. approximately one inch apart or other preset distance) to a fully opened position (e.g. approximately three inches apart or other preset distance) and any increment in between. The springs 31 serve to bias the wall assemblies 18 (and thus the spindle flanges 14) towards one another (e.g., into the default position). Those skilled in the art will appreciate that the default distance and fully open distance may vary, for example depending on printer type, printer size, application, or the like. The user can pull on one wall assembly 18 or spindle flange 14, and the opposing wall assembly 18 and spindle flange 14 will move in the opposite direction a corresponding amount. The two wall assemblies 18 are related to one another through the cam arm 34 that connects their respective linkage sections 30, such that a motion of one wall assembly 18 will induce the equal and opposite motion of the opposing wall assembly 18.

This relationship between the wall assemblies 18 permits media rolls 11 of varying widths to be handled in a similar manner regardless of width. Each wall assembly 18 and spindle flange 14 will exert a sufficient and equivalent clamping force on the media roll 11 inserted therebetween to maintain a position of the media roll 11 in a center of the paper bucket 10, and to guide the media roll 11 into a printing mechanism in a centered position, regardless of the width of the media roll 11.

Each spindle flange 14 may comprise a cylindrical projection 42. The cylindrical projections 42 extend towards one another (i.e., towards the opposing spindle flange 14) and into a center of the paper bucket 10. The cylindrical projections 42 are coaxial and oppositely disposed, and are sized to fit inside an open hollow core of the media roll 11. Each cylindrical projection 42 comprise a plurality of coaxial stepped projections, each of the stepped projections being progressively smaller in a direction towards the center of the paper bucket 10 and sized to fit within a correspondingly different size (diameter) of the hollow core of a media roll 11. Paired with the opposing spindle flange 14 in the bucket assembly 10, these two cylindrical projections 42 will suspend the media roll 11 and rotate as media from the media roll 11 is drawn into the printer mechanism during a printing event. The suspension of the media roll 11 and spinning of the spindle flanges 14 with the media roll 11 reduces the force required to draw the media into the printer mechanism during the printing event.

Figure 6:
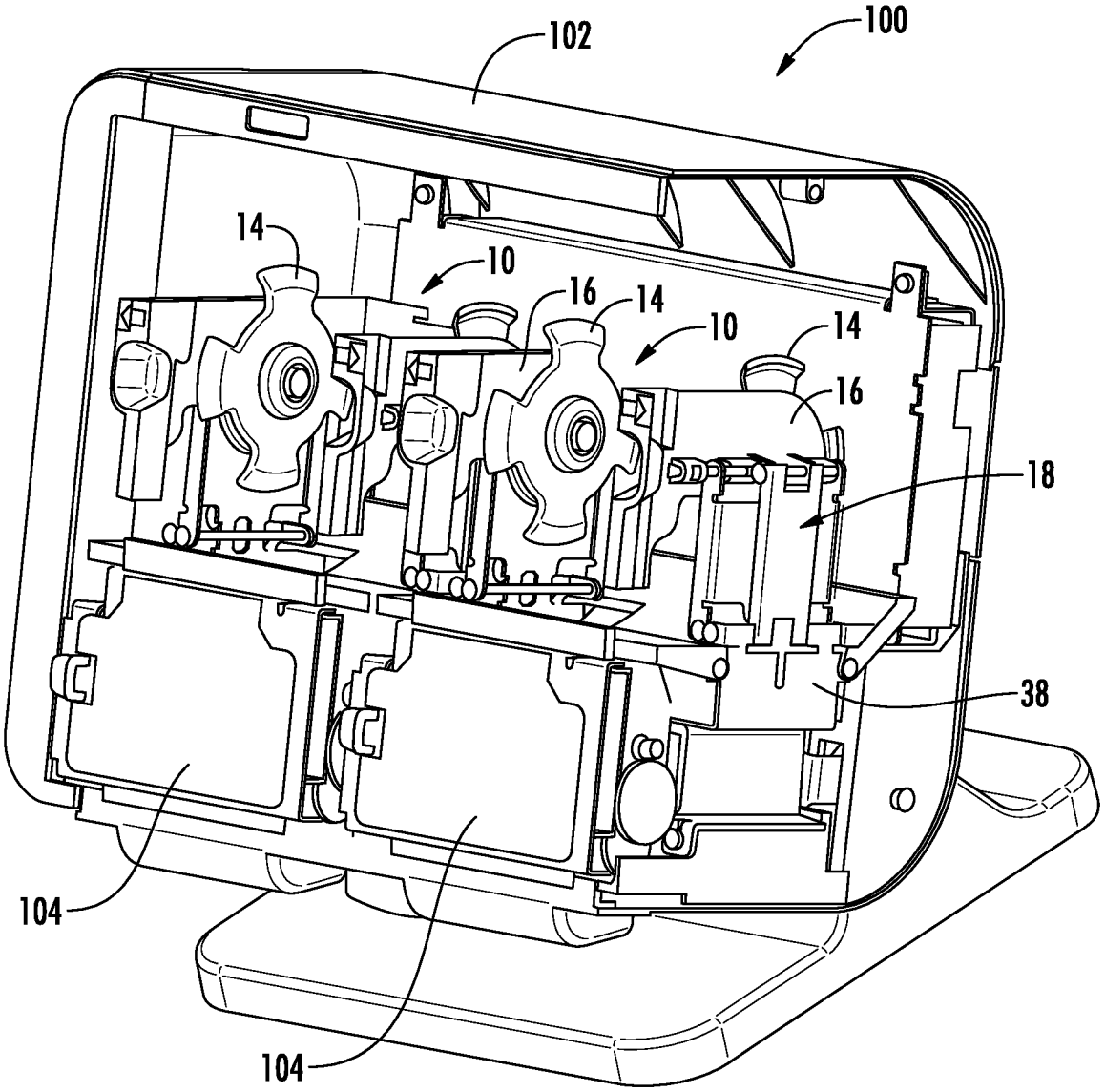
FIG. 6 shows an example embodiment of a printer with a paper bucket in accordance with the present invention.

The present invention also encompasses a printer with an adjustable paper bucket, as shown in FIG. 6. An example embodiment of a printer 100 in accordance with the present invention comprises a printer housing 102, a printer mechanism 104 disposed in the printer housing 102, and a paper bucket 10 disposed in the printer housing 102 adapted to hold a media roll to be fed into the printer mechanism 104. FIG. 6 shows an example embodiment of a printer 100 having two printer mechanisms 104 each with a corresponding paper bucket 10. However, those skilled in the art will appreciate that the printer 100 may comprise a single printer mechanism 104 and paper bucket 10.

The paper bucket 10 comprises a self-adjusting spindle mechanism for accommodating media rolls of varying widths as discussed above in connection with FIGS. 1-5. The self-adjusting spindle mechanism may comprise oppositely disposed wall assemblies 18 pivotally mounted in a bucket frame 38 of the paper bucket 10 and oppositely disposed vertical flanges 16, each of the vertical flanges 16 being pivotally mounted to a respective one of the wall assemblies 18. A spindle flange 14 may be rotatably mounted to each vertical flange 16 for accepting the media roll therebetween. A motion linkage 28 (not visible in FIG. 6) connects the wall assemblies 18 together such that a movement of one of the wall assemblies 18 results in an equal and opposite movement of the other one of the wall assemblies 18.

The printer 100 may also include additional features discussed above in connection with FIGS. 1-5 showing the various embodiments of the paper bucket 10.

The present invention also encompasses a method for providing an adjustable paper bucket 10 for accommodating media rolls of varying widths. In one example embodiment, the method may comprise providing a bucket frame 38, pivotally mounting oppositely disposed wall assemblies 18 in the bucket frame 38, providing oppositely disposed vertical flanges 16, each of the vertical flanges 16 being pivotally mounted to a respective one of the wall assemblies 18, and rotatably mounting a spindle flange 14 to each vertical flange 16 for accepting a media roll therebetween. The wall assemblies 18 may be connected together via a motion linkage 28 such that a movement of one of the wall assemblies 18 results in an equal and opposite movement of the other one of the wall assemblies 18.

It should now be appreciated that the present invention provides advantageous apparatus and methods for accommodating different sized media rolls in a printer paper bucket.

Although the invention has been described in connection with various illustrated embodiments, numerous modifications and adaptations may be made thereto without departing from the spirit and scope of the invention as set forth in the claims.

What is claimed is:

1. An adjustable paper bucket for accommodating media rolls of varying widths, comprising;

a bucket frame;

oppositely disposed wall assemblies pivotally mounted in the bucket frame;

oppositely disposed vertical flanges, each of the vertical flanges being pivotally mounted to a respective one of the wall assemblies;

a spindle flange rotatably mounted to each vertical flange for accepting a media roll therebetween;

a motion linkage connecting the wall assemblies together such that a movement of one of the wall assemblies results in an equal and opposite movement of the other one of the wall assemblies.

2. An adjustable paper bucket in accordance with claim 1, wherein the vertical flanges are each pivotally mounted to the wall assembly via two shafts arranged to maintain the vertical flanges and the spindle flanges in a vertical orientation regardless of positioning of the wall assemblies.

3. An adjustable paper bucket in accordance with claim 1, wherein the wall assemblies each comprise:

a central pivoting support pivotally connected to the bucket frame and a corresponding one of the vertical flanges; and an orienting member pivotally connected to the bucket frame and a corresponding one of the vertical flanges.

4. An adjustable paper bucket in accordance with claim 3, wherein:

a corresponding first shaft pivotally connects each of the vertical flanges to a top section of the corresponding central pivoting support; and a corresponding second shaft pivotally connects each of the vertical flanges to a top section of the orienting member.

5. An adjustable paper bucket in accordance with claim 4, wherein a corresponding third shaft pivotally connects each respective end of the motion linkage to a bottom section of the corresponding central pivoting support.

6. An adjustable paper bucket in accordance with claim 5, wherein:

a corresponding fourth shaft pivotally connects a bottom section of each of the corresponding orienting members to the bucket frame; and a corresponding fifth shaft pivotally connects a bottom section of each of the central pivoting supports to the bucket frame.

7. An adjustable paper bucket in accordance with claim 6, wherein the first shafts, the second shafts, the third shafts, the fourth shafts, and the fifth shafts all extend parallel to one another.

8. An adjustable paper bucket in accordance with claim 1, wherein the motion linkage comprises:

a respective linkage section pivotally connected on one end to a bottom section of each central pivoting support and connected on the other end to a cam arm of a cam via a pin that has a sliding connection to a fitted slot in the cam arm.

9. An adjustable paper bucket in accordance with claim 8, wherein the motion linkage further comprises a respective spring connecting each linkage section to the bucket frame.

10. An adjustable paper bucket in accordance with claim 9, wherein the springs biases the wall assemblies and spindle flanges towards one another into a default position.

11. An adjustable paper bucket in accordance with claim 1, wherein the spindle flanges are biased towards one another in a default position a preset distance apart.

12. An adjustable paper bucket in accordance with claim 1, wherein:

the spindle flanges are movable between a predefined default position and a predefined fully opened position to accommodate the media roll; and a width of the media roll acceptable by the spindle flanges is any width between the predefined default position and the predefined fully open position.

13. An adjustable paper bucket in accordance with claim 12, wherein the spindle flanges maintain the media roll in a centered position in the paper bucket regardless of the width of the media roll.

14. An adjustable paper bucket in accordance with claim 1, wherein:

the spindle flanges each comprise a cylindrical projection, the cylindrical projections being coaxial and extending towards one another into a center of the paper bucket; and the cylindrical projections are sized to fit inside a hollow core of the media roll.

15. An adjustable paper bucket in accordance with claim 14, wherein the cylindrical projections each comprise a plurality of coaxial stepped projections, each of the stepped projections being progressively smaller in a direction towards the center of the paper bucket and sized to fit within a correspondingly different size of the hollow core.

16. An adjustable paper bucket in accordance with claim 1, wherein the spindle flanges rotate as media from the media roll is drawn into a printer.

17. A printer, comprising:

a printer housing;

a printer mechanism disposed in the printer housing;

a paper bucket disposed in the printer housing adapted to hold a media roll to be fed into the printer mechanism;

the paper bucket comprising a self-adjusting spindle mechanism for accommodating media rolls of varying widths, the self-adjusting spindle mechanism comprising:

oppositely disposed wall assemblies pivotally mounted in a bucket frame of the paper bucket;

oppositely disposed vertical flanges, each of the vertical flanges being pivotally mounted to a respective one of the wall assemblies;

a spindle flange rotatably mounted to each vertical flange for accepting the media roll therebetween;

a motion linkage connecting the wall assemblies together such that a movement of one of the wall assemblies results in an equal and opposite movement of the other one of the wall assemblies.

18. A method for providing adjustable paper bucket for accommodating media rolls of varying widths, comprising;

providing a bucket frame;

pivotally mounting oppositely disposed wall assemblies in the bucket frame;

providing oppositely disposed vertical flanges, each of the vertical flanges being pivotally mounted to a respective one of the wall assemblies;

rotatably mounting a spindle flange to each vertical flange for accepting a media roll therebetween;

connecting the wall assemblies together via a motion linkage such that a movement of one of the wall assemblies results in an equal and opposite movement of the other one of the wall assemblies.

* * * * *